US006643891B1

(12) United States Patent
Jerstroem et al.

(10) Patent No.: US 6,643,891 B1
(45) Date of Patent: Nov. 11, 2003

(54) DUSTPAN WITH LOCKING HANDLE AND ASSOCIATED BROOM

(75) Inventors: Goeran Jerstroem, New York, NY (US); Kevin R. Lozeau, Ridge, NY (US); Marco Perry, Brooklyn, NY (US)

(73) Assignee: WKI Holding Company, Inc., Reston, VA (US)

( * ) Notice: Subject to any disclaimer, the term of this patent is extended or adjusted under 35 U.S.C. 154(b) by 91 days.

(21) Appl. No.: 10/043,914

(22) Filed: Jan. 11, 2002

(51) Int. Cl.[7] ..... A47L 13/52
(52) U.S. Cl. ..... 15/257.2; 15/257.1; 15/257.7
(58) Field of Search ..... 15/144.1, 257.1, 15/257.2, 257.7, 257.9

(56) References Cited

U.S. PATENT DOCUMENTS

| | | | | |
|---|---|---|---|---|
| 390,781 | A | | 10/1888 | Hebden et al. |
| 535,372 | A | | 3/1895 | Hebden |
| 573,460 | A | | 12/1896 | Gerow |
| 1,203,697 | A | | 11/1916 | Bump |
| 1,893,426 | A | * | 1/1933 | Mahoney |
| 2,553,727 | A | * | 5/1951 | Schlutz |
| 3,802,729 | A | | 4/1974 | Akre |
| 3,971,095 | A | | 7/1976 | Fish, Sr. |
| 5,343,589 | A | | 9/1994 | Davenport |
| 5,379,481 | A | | 1/1995 | DeMars |
| 5,425,153 | A | | 6/1995 | Vosbikian |
| 6,030,011 | A | | 2/2000 | Layton |
| 6,282,745 | B1 | | 9/2001 | Alt |

* cited by examiner

*Primary Examiner*—Randall E. Chin
(74) *Attorney, Agent, or Firm*—Seyfarth Shaw

(57) ABSTRACT

A dustpan includes an open-front receptacle, at least one elongated rail on the receptacle, an elongated handle having a coupling portion, and a coupling mechanism slidably coupled to the at least one rail and pivotally coupled to the coupling portion of the handle so that the handle is both slidably and pivotally moveable relative to the receptacle between use and storage positions. A broom includes an elongated second handle and a head carrying set of bristles, the head having a housing with curved side portions shaped and dimensioned to respectively nest in recesses in the dustpan handle in a stowed condition clipped to the dustpan handle in such a way that it does not interfere with the pivoting and sliding movement of the dustpan handle. The dustpan receptacle can be stood on its flat rear end wall with the stowed broom received therein.

20 Claims, 6 Drawing Sheets

DUSTPAN WITH LOCKING HANDLE AND ASSOCIATED BROOM

BACKGROUND

This application relates to devices for use in cleaning floors and, specifically, to tools or utensils for sweeping. The application relates in particular to dustpan and broom combinations.

Dustpans, brooms and combinations thereof have long been provided. Indeed, it has long been known to have dustpans with long handles so that they can be operated while the user is in an upright or standing position, as well as to have arrangements wherein the handles of the broom and dustpan can be clipped together for storage. In particular, arrangements have been provided wherein the broom head and/or bristles are stored within the dustpan receptacle when not in use.

However, heretofore, such combinations have required that the handles of the dustpan and broom be separated from each other in order to withdraw the broom bristles from the dustpan receptacle. Dustpans with pivoting handles have also been provided but, heretofore, they have not been capable of pivoting movement while the broom handle is connected thereto. Also, while it is known to provide dustpans with pivoting handles which can be latched in different positions, the movement to and from a latched condition has heretofore required the use of two hands, with one had to operate the dustpan handle and another to operate a latch mechanism, for example.

SUMMARY

There is disclosed in this application a dustpan/broom combination which avoids the disadvantages of prior arrangements, while affording additional structural and operating advantages. An important aspect is the provision of a dustpan with a long pivoting handle which can be easily moved between use and storage conditions with a single hand.

Another aspect is the provision of a dustpan and broom combination, wherein the broom is connectable to the dustpan handle and is moveable therewith between the various conditions of the dustpan handle.

Another aspect of the provision of a combination of the type set forth, which is a relatively simple and economical construction.

Certain ones of these and other aspects may be attained by providing a dustpan comprising an open-front receptacle, at least one elongated rail on the receptacle, an elongated handle having a coupling portion, and coupling mechanism slidably coupled to the at least one rail and pivotally coupled to the coupling portion of the handle so that the handle is both slidably and pivotally movable relative to the receptacle.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
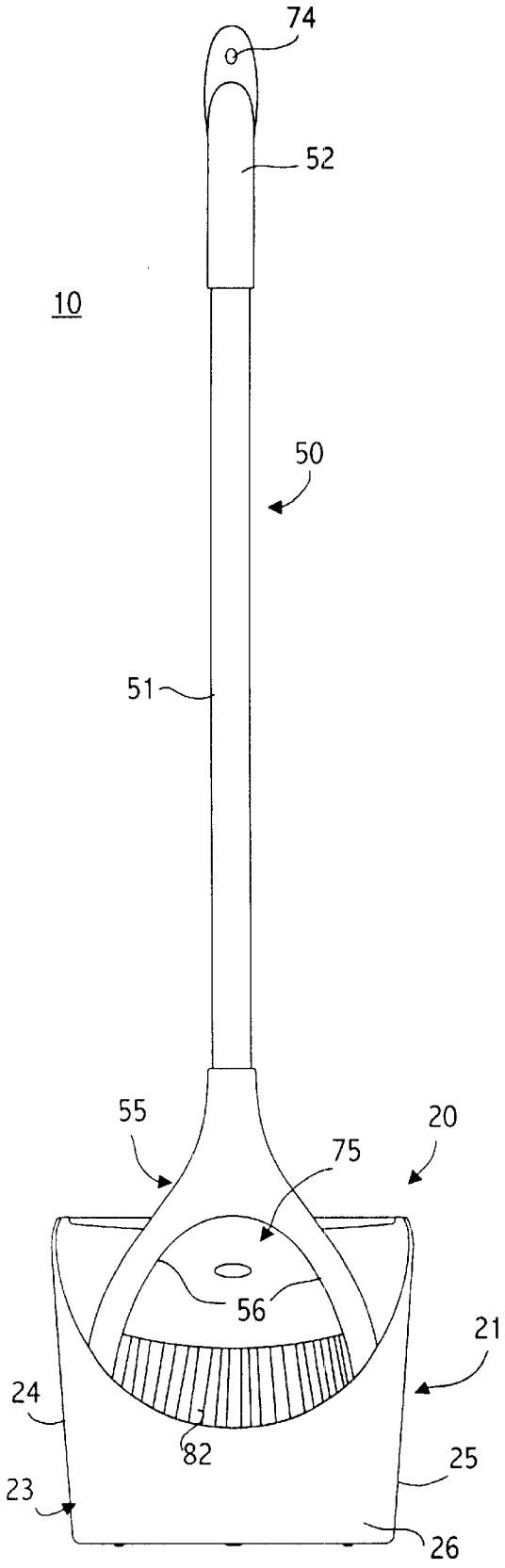
FIG. 1 is a front elevational view of the combination of a dustpan and broom in a stowed condition.
Figure 2:
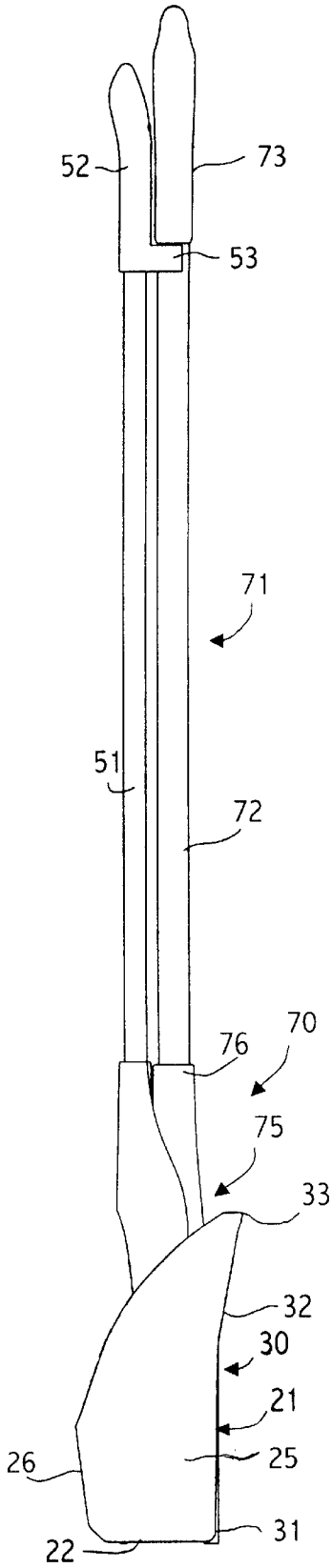
FIG. 2 is a side elevational view of the combination of FIG. 1.
Figure 3:
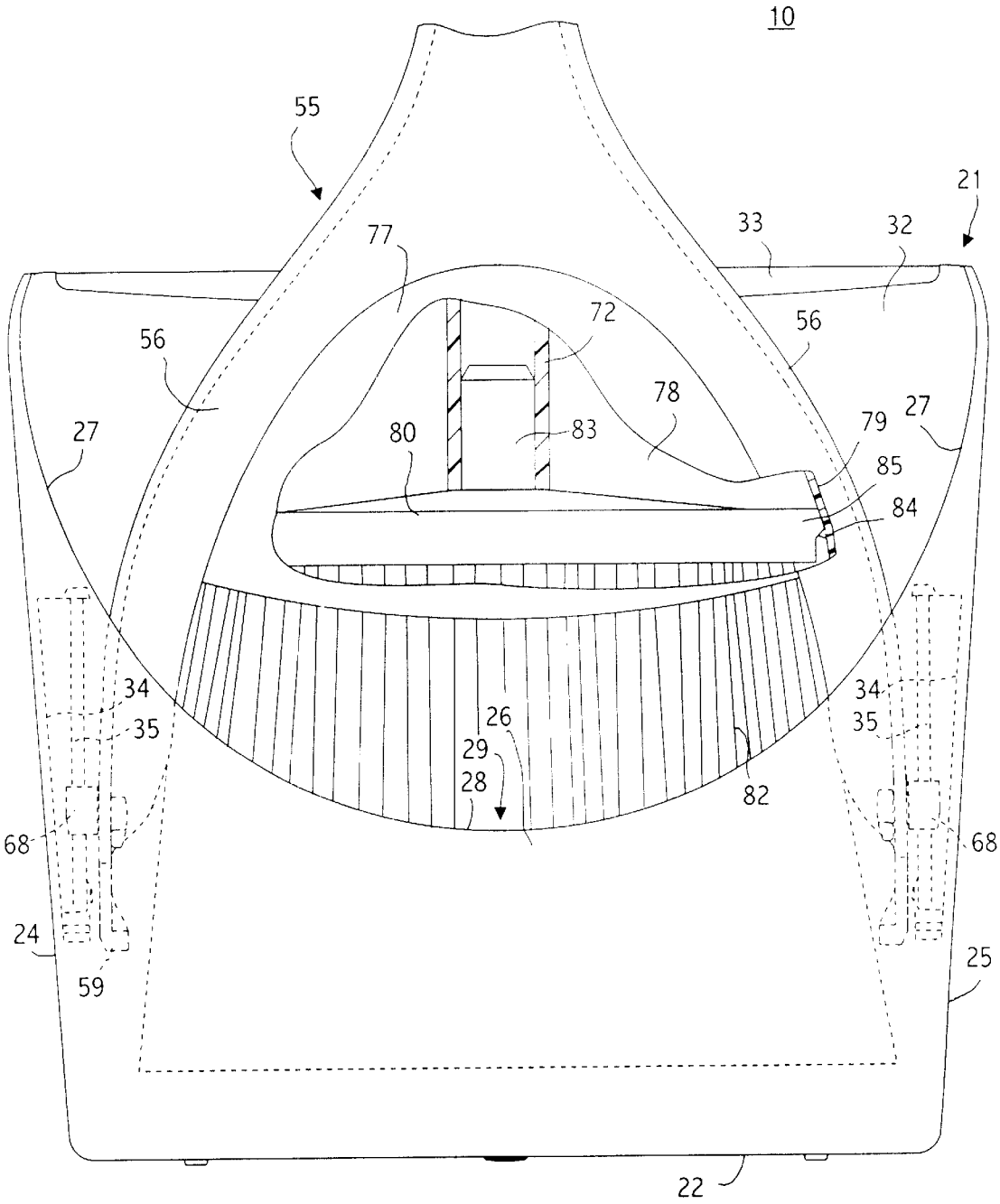
FIG. 3 is an enlarged, fragmentary view of the lower end of the combination of FIG. 1, with portions broken away more clearly to show internal construction.
Figure 6:
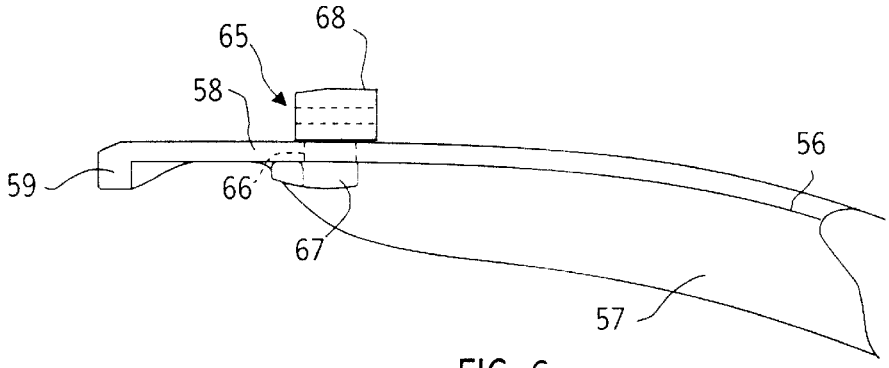
FIG. 6 is an enlarged, fragmentary view of the end portion of the left-hand leg of the handle assembly of FIG. 4.
Figure 8:
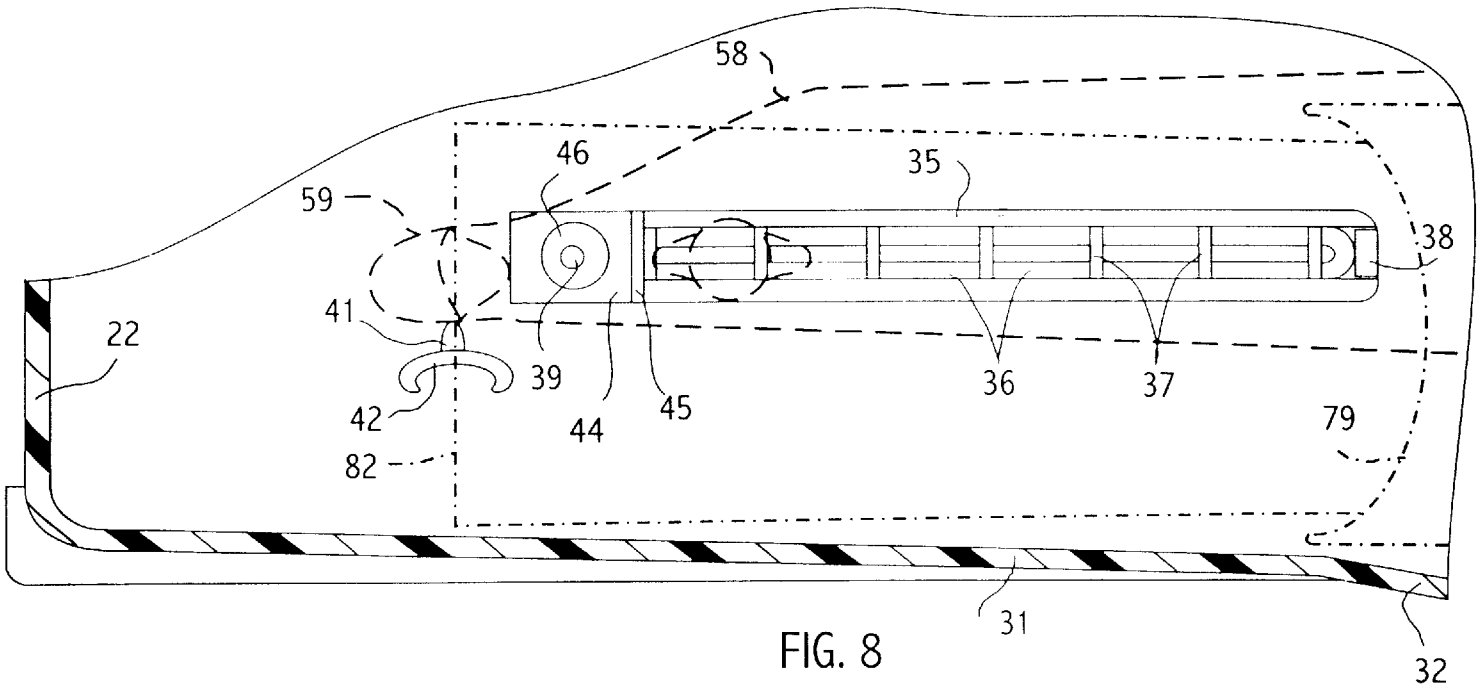
FIG. 8 is a side elevational view of the rail assembly of FIG. 7, with the dustpan handle assembly in its storage condition with the associated broom stored thereon illustrated in phantom.

Referring to FIGS. 1–3, there is illustrated a combination, generally designated by the numeral 10, including a dustpan 20 and a broom 70. Referring also to FIGS. 6 and 8, the dustpan 20 includes an open-front receptacle 21 including a substantially flat rear end wall 22, integral along three sides thereof with a forwardly projecting peripheral wall structure 23 including opposed side walls 24 and 25 and a top wall 26. The side walls 24 and 25 may diverge slightly forwardly and may be slightly convex, as viewed from the outside thereof and respectively have downwardly and forwardly sloping upper front edges 27. The top wall 26 may also be slightly convex, as viewed from the outside, and has a concavely curved front edge 28 which is continuous with the front edges 27 of the side walls 24 and 25 and defines a cutaway arcuate front opening 29 in the top wall 26, as can best be seen in FIGS. 1 and 3. The peripheral wall structure 23 also includes a generally rectangular bottom wall 30 having a flat rear portion 31 and a slightly downwardly and forwardly sloping front portion 32 terminating in a beveled lip 33.

Figure 5:
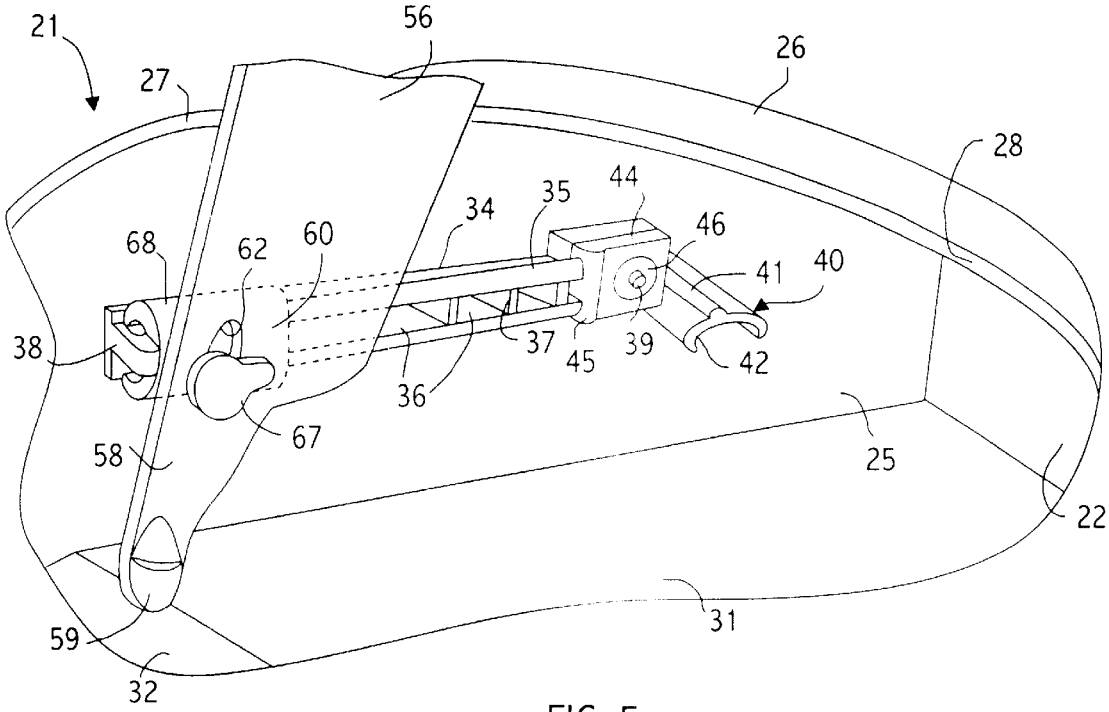
FIG. 5 is an enlarged, fragmentary, perspective view of the cooperation of the dustpan handle with dustpan receptacle in a use condition.
Figure 7:
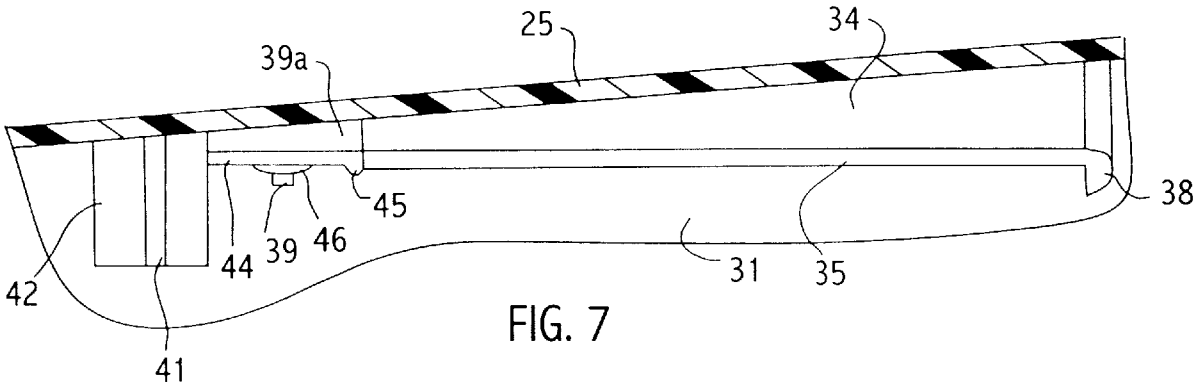
FIG. 7 is a further enlarged, fragmentary sectional view of the left-hand side wall of the dustpan of the receptacle, as viewed in FIG. 3.

Referring also to FIGS. 5 and 7, respectively integral with the side walls 24 and 25 and projecting laterally inwardly therefrom are elongated webs 34, which are substantially parallel to the bottom wall 30 and are integral at their inner ends with rails 35 which are generally oval in transverse cross section, the oval having a major axis substantially perpendicular to the bottom wall 31. The lateral inner surfaces of the rail 35 are cut away to define recesses 36 spaced apart by stiffening webs 37. Projecting laterally inwardly from the forward end of each rail of 35 is a short stop lug 38. Integral with each sidewall 24, 25 a short distance rearwardly of the rear end of the associate rail 35 is a mounting post 39 with narrow rectangular bosses 39*a* immediately thereabove and therebelow (one shown in FIG. 7). Respectively integral with the side walls 24 and 25 and projecting laterally inwardly therefrom, just rearwardly of the mounting posts 39, are retaining projections 40, each including a narrow rectangular rib 41 integral with a downwardly-opening, general C-shaped flange 42 (see FIGS. 7 and 8).

Respectively mounted on the mounting posts 39 are two substantially rectangular stop plates 44, each having a circular central opening therethrough receiving the associated post 39, being retained in place by a toothed washer 46, such as a Tinnerman washer, which fits over the associated mounting lug 39 to firmly mount the stop plate 44 in place. The bosses 39*a* provide parallel seating surfaces for the stop plates 44 on the diverging side walls 24, 25. Each stop plate 44 has a laterally inwardly projecting flange 45 at a forward end thereof which is disposed in use against the rear or inner end of the associated rail 35.

Figure 4:
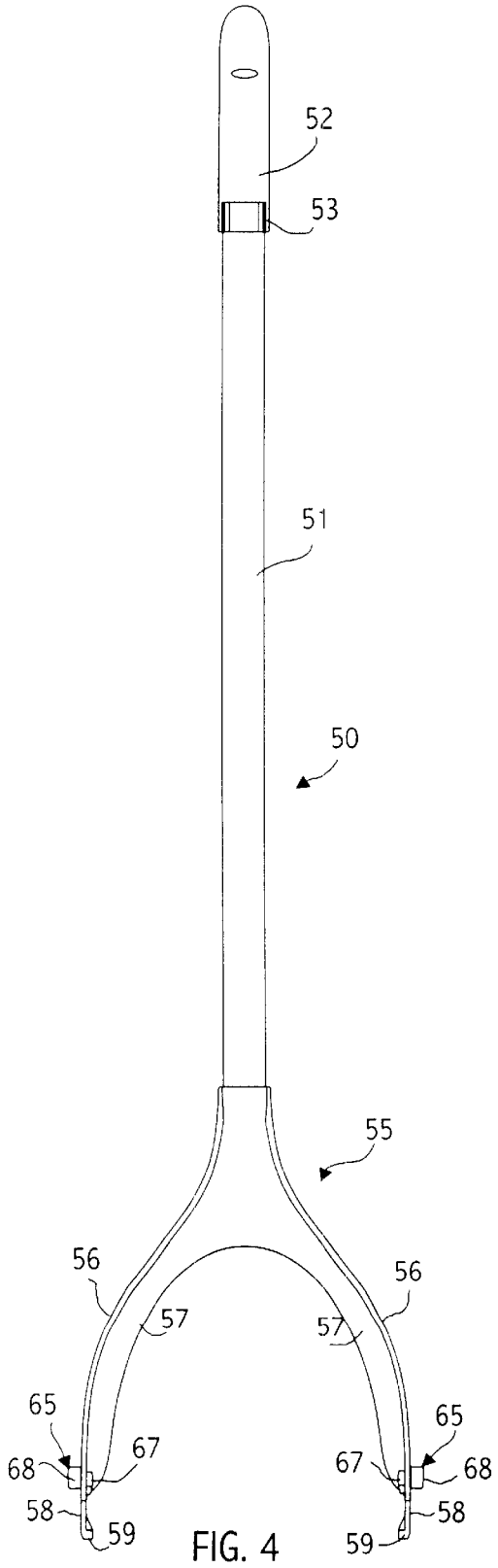
FIG. 4 is a front elevational view of the handle assembly of the dustpan of FIG. 1.

Referring also to FIG. 4, the dustpan 20 has a handle assembly 50 including an elongated shaft 51 provided at the distal end thereof with an overmolded grip 52, which may be formed of a suitable elastomeric material, such as that sold under the trademark SANTOPRENE. The grip 52 is provided at its lower end with a forwardly projecting C-clip 53. The proximal end of the shaft 51 is socketed in the neck portion of a generally y-shaped yoke 55 having a pair of legs 56, respectively defining concave recesses 57 on the sides thereof generally facing downwardly and forwardly in use. Each leg 56 is provided at its proximal end with a retaining extension 58 provided at its end with a thickened stiffening lug 59.

Referring in particular to FIGS. 5 and 6, each retaining extension 58 has formed therethrough a generally keyhole-shaped aperture 60, including a circular portion 61 and a generally triangular tongue portion 62. The legs 56 are disposed in use just laterally inwardly of the rails 35, being respectively connected thereto by couplers 65. Each coupler 65 includes a generally cylindrical shank 66 which extends through the aperture 60 in the associated leg 56, the shank 66 being provided at its inner end with a keyhole-shaped head 67 dimensioned to fit through the aperture 60 in the associated leg 56 in one orientation. Each coupler 65 is provided at the opposite end of the shank 66 with a generally C-shaped channel 68 adapted to slidably receive the associated rail 35 therein, as can best be seen in FIG. 5.

In assembly, the heads 67 of the couplers 65 are respectively fitted through the keyhole-shaped apertures 60 in the legs 56 from the outside to the inside, and then rotated 180 degrees, so that the tongue portions 62 extends toward the distal ends of the legs (see FIG. 6). Then, the channels 68 are slipped over the rear ends of the rails 35 and the stop plates 44 are then mounted in place, the stop plate flanges 45 cooperating with the stop lugs 38 on the rails 35 to prevent the couplers 65 from coming off the rails 35. Thus, the couplers 65 cooperate to form a coupling mechanism which permits sliding movement of the handle 50 along the rails 35 between a forward position against the stop lugs 38 (see FIG. 5) and a rearward position against the stop flanges 45 (see FIGS. 3 and 8), while at the same time accommodating pivotal movement of the handle 50 about the axes of the coupler shanks 66 relative to the receptacle 21. When the handle 50 is in its rearward position and in a storage condition generally parallel to the bottom wall 30, the retaining extensions 58 of the handle legs 56 will respectively overlie the retaining projection ribs 41, as can best be seen in FIG. 8, for a purpose to be explained more fully below.

When the handle 50 is slid to its forward position it can be pivoted between the storage condition and an upright use position (see FIG. 5), wherein the longitudinal axis of the shaft 51 is disposed at a large acute angle to the bottom wall 30. More specifically, as the handle 50 is pivoted upwardly, the distal ends of the retaining extensions 58 frictionally engage the inner surface of the bottom wall 30, just rearwardly of the sloping front portion 32 thereof and, as pivoting movement of the handle 50 continues, the bottom wall 30 flexes slightly to allow the distal ends of the retaining extensions 58 to cam forwardly past the junction between the rear portion 31 and sloping front portion 32 of the bottom wall 30 until the handle legs 56 engage the front edge 28 of the top wall 26 in a use position, wherein the longitudinal axis of the shaft 51 is tilted just slightly rearwardly past the vertical (see FIG. 5). Thus, the retaining extensions 58 undergo a camming, over-center movement to resiliently retain the handle 50 in its upright use condition. It will be appreciated that the arcuate front opening 29 in the top wall 26 accommodates the pivotal movement of the handle 50.

Figure 9:
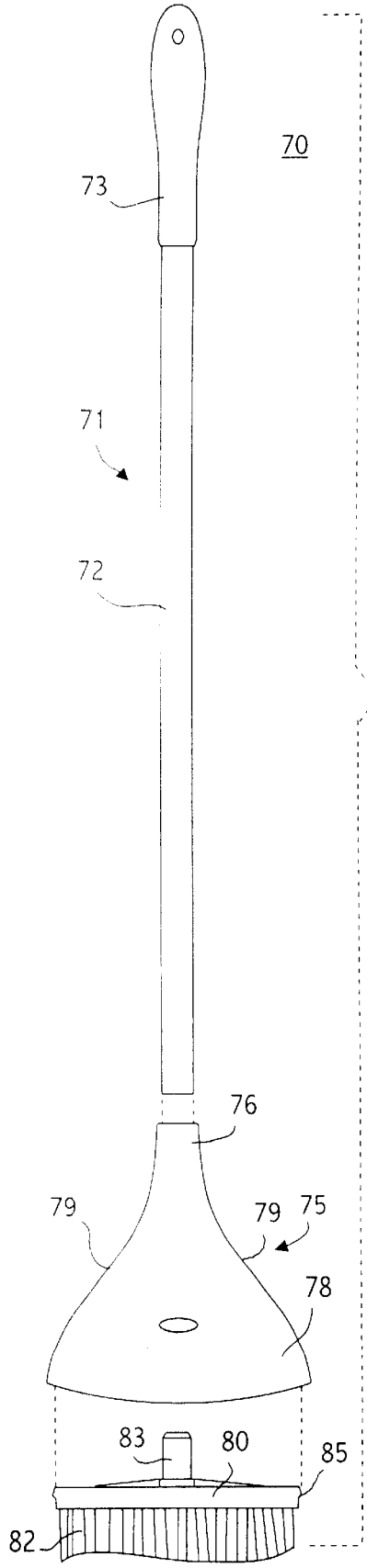
FIG. 9 is an exploded front elevational view of the broom of the combination of FIG. 1.

Referring also to FIG. 9, the broom 70 includes a handle 71 having an elongated hollow tubular shaft 72 provided at its distal end with an overmolded grip 73, which may be formed of SANTOPRENE and may have a hole 74 formed therethrough at the distal end thereof. The broom 70 also includes a head 75 having a generally flattened, hollow housing 74 provided with a cylindrical neck 76 and flattened, generally triangularly-shaped front and rear walls 77 and 78, joined by arcuate, sloping sides 79. The broom 70 includes a plastic bristle plate 80 having holes or apertures formed in the lower surface thereof for respectively receiving bunches of bristles 82, which may be secured in place by adhesive or other suitable means. The bristle plate 80 has a neck post 83 projecting upwardly therefrom centrally thereof and is received in the lower end of the hollow handle shaft 72, being secured in place by any suitable means. The bristle plate 80 has a snap rim 85 formed on the outer periphery thereof adapted for engagement with snap beads 84 projecting laterally inwardly from the head housing 74 adjacent to its lower end (see FIG. 3).

In assembly, the lower end of the handle shaft 72 is fitted through the upper end of the head housing neck 76 and is secured to the neck post 83 of the bristle plate 80. Then, the handle shaft 72 is pulled upwardly, drawing the bristle plate 80 upwardly into the lower end of the head housing 74 until the snap rim 85 snaps past the snap beads 84, for locking the bristle plate 80 in place, with the bristles 82 projecting downwardly well below the lower end of the head housing 74. The handle shaft 72 is preferably circular in transverse cross section and is dimensioned to be snap-fitted in the C-clip 53 of the dustpan-handle 50 (see FIG. 2) for attaching the two together. Also, as can best be seen in FIGS. 2 and 3, the broom head 75 and, in particular, the sloping sides 79 thereof, are dimensioned and shaped to nest in the leg recesses 57 of the dustpan handle 50 in a stowed condition, with the broom handle shaft 72 retained in the C-clip 53 just below the grip 73. When thus stowed, the broom 70 can move with the dustpan handle 50 and does not interfere with either its pivoting or sliding movements.

Thus, after the broom 70 has been attached to the dustpan handle 50, preferably when the handle 50 is in its upright use position, the dustpan handle 50 can be pivoted downwardly to its storage position. Then, when the dustpan handle is held upright, the dustpan receptacle 21 will, by gravity, hang freely with the couplers 65 in their forwardmost positions against the stop lugs 38. The receptacle 21 may then be supported on its rear end wall 22 and the handle 50 and attached broom 70 may be dropped into the receptacle 21, with the retaining extensions 58 respectively riding over the retaining projections 40 (see FIGS. 2, 3 and 8). Thus, the engagement of the retaining extensions 58 with the retaining projections 40 prevents pivotal movement of the handle 50 toward the top wall 26, while engagement of the broom head housing 74 with the receptacle bottom wall 30 prevents pivotal movement in the opposite direction, so that the combination 10 will remain balanced on the receptacle rear end wall 22 and not tip over.

Figure 10:
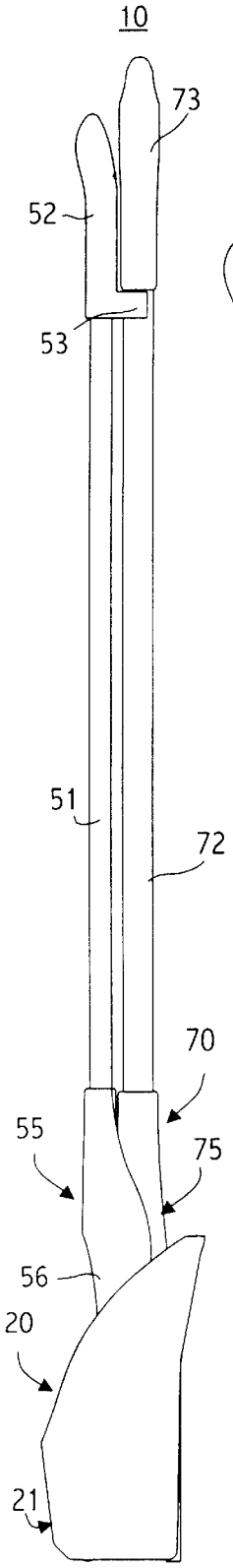
FIG. 10 is a slightly reduced view, similar to FIG. 2, but showing the handles lifted to the upper ends of the rails on the receptacle.
Figure 11:
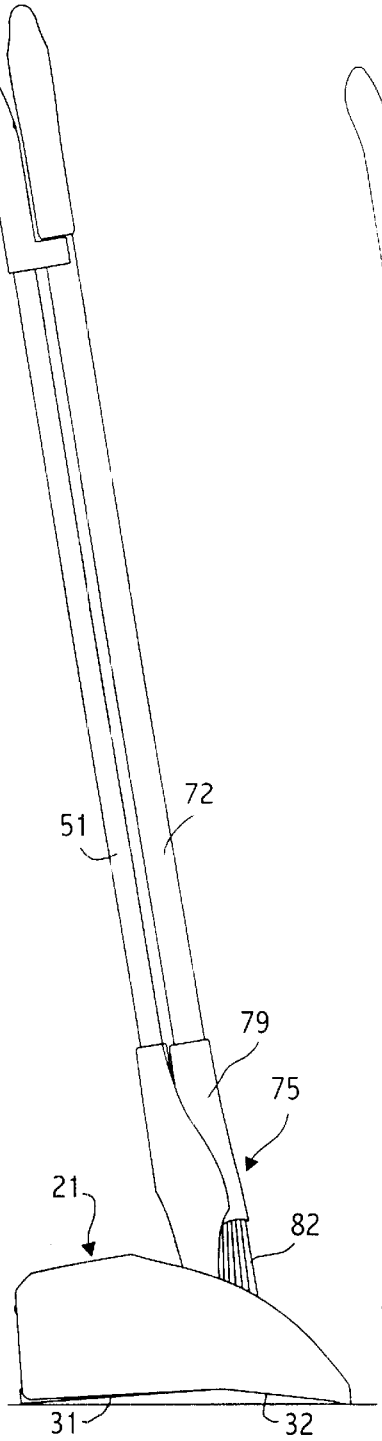
FIG. 11 shows the combination of FIG. 10 with the dustpan disposed in its use condition.
Figure 12:
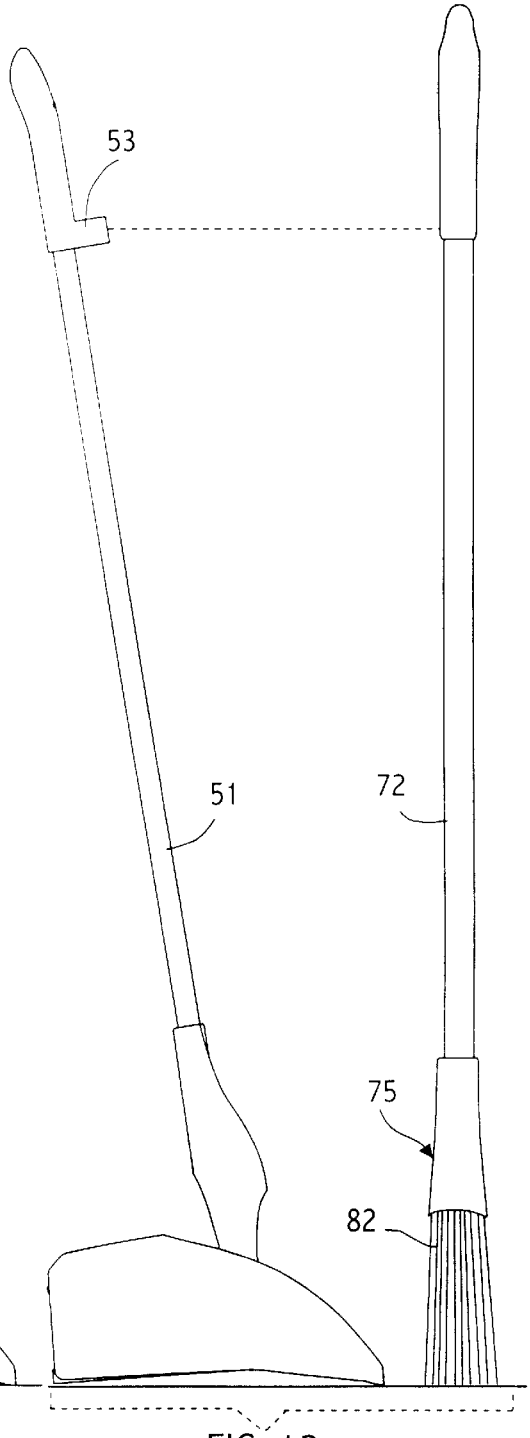
FIG. 12 is a view similar to FIG. 11, illustrating detachment of the broom from the dustpan for use.

When it is desired to use the combination 10, the joined handles are simply grasped and pulled upwardly, allowing the receptacle 21 to drop away until the couplers 65 stop against the stop lugs 38 at the forward ends of the rails 35, as shown in FIG. 10. Then, the receptacle may be laid down with its bottom wall 30 on the floor 15 and the handle 50 pivoted to its use position, as explained above (see FIG. 11), whereupon the broom 70 can be disengaged from the handle 50 for use, as shown in FIG. 12.

Preferably, the combination 10 is formed of suitable plastic materials, except for the Tinnerman washers 46 and the handle grips 52 and 73. The broom bristles 82 may also be formed of suitable plastic materials. Preferably, the receptacle 21, the handle yoke 55 and the broom head 75 are of molded, one-piece construction, as is the bristle plate 80. However, it will be appreciated that, if desired, other materials and fabrication techniques could be used.

From the foregoing, it can be seen that there has been provided an improved dustpan and broom combination, wherein the dustpan handle can be easily moved between storage and use positions with one hand, by undergoing a combined pivoting and sliding movement, and the broom can be stowed on the dustpan handle without interfering with its pivoting and sliding movements.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A dustpan comprising:

an open-front receptacle, at least one elongated rail on the receptacle, an elongated handle having a coupling portion, and a coupling mechanism slidably coupled to the at least one rail and pivotally coupled to the coupling portion of the handle so that the handle is both slidably and pivotally movable relative to the receptacle.

2. The dustpan of claim 1, wherein the at least one elongated rail includes two laterally spaced-apart rails, the coupling portion of the handle being in the form of a yoke having a pair of legs, the coupling mechanism including two couplers respectively slidably coupled to the rails and respectively pivotally coupled to the legs.

3. The dustpan of claim 2, wherein the receptacle includes a pair of upstanding side walls, the rails being respectively disposed on the side walls.

4. The dustpan of claim 3, wherein the rails are respectively disposed on the inner surfaces of the side walls.

5. The dustpan of claim 1, wherein the receptacle includes a rear end wall and a peripheral wall structure integral with the rear end wall and projecting forwardly therefrom, the peripheral wall structure including a top wall portion which is shorter than the remainder of the peripheral wall structure to facilitate pivotal movement of the handle.

6. The dustpan of claim 1, wherein the coupling portion has an aperture therein, the coupling mechanism including a pivot shaft received through the aperture and provided at one end with a generally channel-shaped portion slidably receiving the at least one elongated rail.

7. A dustpan comprising:

an open-front receptacle having a bottom wall, at least one elongated rail on the receptacle, an elongated handle having a longitudinal axis and a coupling portion and a retaining portion, a coupling mechanism slidably coupled to the at least one rail and pivotally coupled to the coupling portion so that the handle is slidably movable along the at least one rail between forward and rearward positions and is pivotally movable relative to the receptacle between a storage condition generally parallel to the bottom wall and a use condition generally perpendicular to the bottom wall, the retaining portion being disposed for frictional engagement with the bottom wall to retain the handle in its forward position and use condition.

8. The dustpan of claim 7, wherein the retaining portion is disposed at an end of the handle.

9. The dustpan of claim 8, wherein the retaining portion includes a projection frictionally engageable with the bottom wall, the bottom wall being sufficiently flexible and resilient to permit an over-center movement of the handle to its use condition.

10. The dustpan of claim 7, wherein the at least one rail includes two laterally spaced-apart rails, the coupling portion of the handle being in the form of a yoke having a pair of legs, the coupling mechanism including two couplers respectively slidably coupled to the rails and respectively pivotally coupled to the legs.

11. The dustpan of claim 7, wherein the bottom wall has a front edge, the receptacle including a top wall portion having a front edge which is spaced well rearwardly of the front edge of the bottom wall to facilitate pivotal movement of the handle.

12. The dustpan of claim 7, wherein the coupling portion has an aperture therein, the coupling mechanism including a pivot shaft received through the aperture and provided at one end with a generally channel-shaped portion slidably receiving the at least one elongated rail.

13. In combination:

a dustpan including an open-front receptacle having a bottom wall and opposed side walls, an elongated first handle having a yoke at an end thereof including legs respectively pivotally coupled to the side walls, each leg having an elongated recess formed therein; and a broom including an elongated second handle and a head carrying a set of bristles, the head having a housing with curved side portions shaped and dimensioned to respectively nest in the recesses of the legs when the broom is in a stowed condition with the second handle disposed alongside and substantially parallel to the first handle and with the bristles disposed in the receptacle.

14. The combination of claim 13, wherein the first handle includes a clip engageable with the second handle for retaining the broom in the stowed condition.

15. The combination of claim 13, wherein the first handle is pivotally moveable between a storage condition generally parallel to the bottom wall and the use condition generally perpendicular to the bottom wall.

16. The combination of claim 15, wherein the bottom wall has a front edge, the receptacle including a top wall portion having a front edge which is spaced well rearwardly of the front edge of the bottom wall to facilitate pivotal movement of the first handle.

17. The combination of claim 13, and further comprising two elongated rails respectively carried by the side walls, and further comprising coupling mechanism slidably coupling the yoke legs respectively to the rails for sliding movement of the first handle between forward and rearward positions.

18. The combination of claim 17, and further comprising retaining members respectively mounted on the side walls, the legs respectively having retaining portions respectively engageable with the retaining members when the first handle is in its rearward position and in a storage condition disposed substantially parallel to the bottom wall with the broom in its stowed condition, to prevent pivotal movement of the handles.

19. The combination of claim 18, wherein the receptacle has a flat rear end wall on which the dustpan may rest when the first handle is in its rearward position and storage condition with the broom in its stowed condition.

20. The combination of claim 13, wherein the head includes a bristle plate carrying the bristles and fixed to the second handle, the bristle plate being snap-engageable in the head housing.

* * * * *